US008911335B2

(12) United States Patent
Thompson

(10) Patent No.: US 8,911,335 B2
(45) Date of Patent: Dec. 16, 2014

(54) ATHLETE TRAINING AND MONITORING SYSTEM

(71) Applicant: Matt Thompson, Marietta, GA (US)

(72) Inventor: Matt Thompson, Marietta, GA (US)

(73) Assignee: Speed Tracs America LLC, Marietta, GA (US)

( * ) Notice: Subject to any disclaimer, the term of this patent is extended or adjusted under 35 U.S.C. 154(b) by 101 days.

(21) Appl. No.: 13/795,514

(22) Filed: Mar. 12, 2013

(65) Prior Publication Data

US 2013/0244835 A1 Sep. 19, 2013

Related U.S. Application Data

(63) Continuation-in-part of application No. 13/418,769, filed on Mar. 13, 2012.

(51) Int. Cl.

| | |
|---|---|
| ***A63B 21/00*** | (2006.01) |
| ***A63B 24/00*** | (2006.01) |
| ***A63B 21/055*** | (2006.01) |
| ***A63B 21/28*** | (2006.01) |
| ***A63B 21/04*** | (2006.01) |
| ***A63B 5/16*** | (2006.01) |
| ***A63B 21/062*** | (2006.01) |
| ***A63B 23/04*** | (2006.01) |
| *A63B 71/06* | (2006.01) |
| *A63B 71/02* | (2006.01) |

(52) U.S. Cl.

CPC ..... *A63B 21/062* (2013.01); *A63B 2225/50* (2013.01); *A63B 24/00* (2013.01); *A63B 21/1419* (2013.01); *A63B 2225/15* (2013.01); *A63B 2225/20* (2013.01); *A63B 71/0622* (2013.01); *A63B 21/0552* (2013.01); *A63B 21/28* (2013.01); *A63B 2220/51* (2013.01); *A63B 21/0442* (2013.01); *A63B 24/0062* (2013.01); *A63B 2071/027* (2013.01); *A63B 5/16* (2013.01); *A63B 23/047* (2013.01); *A63B 2225/54* (2013.01)

USPC ..... 482/121; 482/104; 482/106; 482/70; 482/74

(58) Field of Classification Search

USPC ..... 482/121, 72, 71, 117, 70

See application file for complete search history.

(56) References Cited

U.S. PATENT DOCUMENTS

| | | | | |
|---|---|---|---|---|
| 4,863,163 | A | 9/1989 | Wehrell | |
| 5,064,190 | A * | 11/1991 | Holt | 482/70 |
| 5,207,624 | A * | 5/1993 | Paskovich | 482/93 |
| 5,803,881 | A | 9/1998 | Miller | |
| 7,169,094 | B2 | 1/2007 | Ardito, III | |
| 7,608,015 | B2 | 10/2009 | Radow | |
| 8,491,446 | B2 | 7/2013 | Hinds et al. | |
| 2003/0013586 | A1 * | 1/2003 | Rothschild | 482/117 |
| 2005/0079956 | A1 * | 4/2005 | Bruno | 482/51 |
| 2008/0119763 | A1 | 5/2008 | Wiener | |
| 2011/0230314 | A1 | 9/2011 | Hoffman | |

* cited by examiner

*Primary Examiner* — Jerome w Donnelly

(74) *Attorney, Agent, or Firm* — Bryan W. Bockhop; Bockhop & Associates, LLC

(57) ABSTRACT

An athlete training device that includes a platform that includes a plurality of spaced apart attachment members disposed adjacent to the periphery of the platform. A pole extends upwardly from the platform and is affixed to the platform. A weight, defining a hole passing therethrough, is disposed on the platform so that the pole passes through the hole. A top plate is affixed to the top of the pole and includes attachment structures disposed about the top plate. An attachment device is coupled to one of the attachment structures. A redirecting device is coupled to one of the attachment members. An elastic cord is attached to the attachment device and is engaged with the redirecting device so that the cord extends radially away from the pole. An exercise device is affixed to the end of the cord.

20 Claims, 6 Drawing Sheets

ATHLETE TRAINING AND MONITORING SYSTEM

CROSS-REFERENCE TO RELATED APPLICATION(S)

This application is a continuation-in-part of, and claims the benefit of, U.S. patent application Ser. No. 13/418,769, filed Mar. 13, 2012, the entirety of which is hereby incorporated herein by reference.

BACKGROUND OF THE INVENTION

1. Field of the Invention

The present invention relates to training devices for athletes and, more specifically, to an athlete training device configured to train more than one athlete.

2. Description of the Related Art

Sports teams employ a variety of devices for training their athletes. Such devices can include weight sets, treadmills, jumping trainers and the like. Most current systems are designed to train single athletes. However, athletes involved in team sports often find that training together often results in better inter-athlete coordination and cooperation. Also, most training devices of the type employed by sports teams tend to be bulky and expensive.

Therefore, there is a need for an athlete training device and method that is inexpensive and that fosters coordination and cooperation between more than one athlete.

SUMMARY OF THE INVENTION

The disadvantages of the prior art are overcome by the present invention which, in one aspect, is an athlete training apparatus that includes a platform, a force redirecting device, an elastic member, a first user coupler and a second user coupler. The platform defines a standing area. The force redirecting device is mounted on the platform. The elastic member has a first end and an opposite second end and is engaged with the force redirecting device. The first user coupler is configured to be coupled to the first end of the elastic member. The first user coupler is also configured to be worn by a first individual. The second user coupler is configured to be coupled to the second end of the elastic member. The second user coupler is also configured to be worn by a second individual. When the first individual stands in the standing area and when the second individual applies a force to the elastic member, the force redirecting device redirects a portion of the force to the second user coupler so that a force having a downward vertical component is applied to the first individual.

In another aspect, the invention is an apparatus for training athletes that includes a platform, four pulleys, a first elastic cord, a second elastic cord, a first belt and a second belt. The four pulleys are spaced apart from each other along different vertices of a rectangle projected onto the platform and are disposition so as to define a standing area therein. Each of the pulleys is coupled to the platform. The four pulleys include a first pair of linearly aligned pulleys disposed along a first side of the rectangle and a second pair of linearly aligned pulleys disposed along a second side of the rectangle that is spaced apart from and parallel to the first side of the rectangle. The first elastic cord has a first end and an opposite second end. The first elastic cord is linearly engaged with each of the first set of pulleys. The second elastic cord has a first end and an opposite second end. The second elastic cord is linearly engaged with each of the second set of pulleys. The first belt has a first side and an opposite second side. The first side is configured to be coupled to the first end of the first elastic cord and the second side is configured to be coupled to the first end of the second elastic cord. The first belt is configured to be worn by a first individual. The second belt has a first side and an opposite second side. The first side is configured to be coupled to the second end of the first elastic cord and the second side is configured to be coupled to the second end of the second elastic cord. The second belt is configured to be worn by a second individual. When the first individual stands in the standing area and when the second individual applies a force to the first elastic cord and the second elastic cord, a portion of the force is directed in a downward direction to the first individual.

In another aspect, the invention is a method of training athletes, including a first individual and a second individual, in which a first individual is placed on a platform. A first end of a first elastic member is affixed to the first individual and a second end of the first elastic member is affixed to the second individual who is not on the platform. When the second individual performs an exercise that imparts a force to the elastic member, at least a portion of the force is redirected so as to apply a downward force to the first individual through the elastic member.

In another aspect, the invention is an athlete training device that includes a substantially planar platform having a periphery. The platform includes a plurality of spaced apart attachment members disposed adjacent to the periphery of the platform. An elongated pole extends upwardly from the platform and has a bottom end and an opposite top end. The bottom end is affixed to the platform. A weight, defining a hole passing therethrough, is disposed on the platform so that the pole passes through the hole. A top plate is affixed to the top end of the pole. The top plate includes a plurality of spaced apart attachment structures disposed about the top plate. An attachment device is coupled to a selected one of the attachment structures. A redirecting device is coupled to a selected one of the attachment members. An elastic cord has a first end and an opposite second end. The first end is attached to the attachment device. The elastic chord is engaged with the redirecting device so that the second end of the cord extends radially away from the pole. An exercise device is affixed to the second end of the cord.

In another aspect, the invention is an integrated athlete training system that includes a substantially planar platform having a periphery. The platform includes a plurality of spaced apart attachment members disposed adjacent to the periphery of the platform. An elongated pole extends upwardly from the platform and has a bottom end and an opposite top end. The bottom end is affixed to the platform. A weight defines a hole passing therethrough. The weight is disposed on the platform so that the pole passes through the hole. A top plate is affixed to the top end of the pole. The top plate includes a plurality of spaced apart attachment structures disposed about the top plate. An attachment device is coupled to a selected one of the attachment structures. A redirecting device is coupled to a selected one of the attachment members. An elastic cord has a first end and an opposite second end. The first end is attached to the attachment device. The elastic chord is engaged with the redirecting device so that the second end of the cord extends radially away from the pole. An exercise device is affixed to the second end of the cord. An electronic strain measuring device is coupled to the cord and is configured to generate a strain signal representative of strain applied to the cord. An electronic exercise measurement device is responsive to the strain signal and is configured to generate an output signal indicative of exercises performed by a user based on the strain signal.

In yet another aspect, the invention is an integrated athlete training unit that includes a substantially planar platform having a periphery, the platform including a plurality of passages defined by the platform so as to pass therethrough. An elongated pole extends upwardly from the platform and has a bottom end and an opposite top end, the bottom end affixed to the platform. A weight defines a hole passing therethrough. The weight is disposed on the platform so that the pole passes through the hole. A top plate is affixed to the top end of the pole. The top plate defines a plurality of holes passing therethrough disposed about the top plate. A plurality of carabineers is each coupled to a different one of the holes. A plurality of pulleys is each coupled to a different one of the attachment members. A plurality of elastic cords each have a first end and an opposite second end. The first end of each cord is attached to a different one of the carabineers. Each elastic chord is engaged with one of the pulleys so that the second end of the cord extends radially away from the pole. Each of a plurality of strain measuring devices is coupled to a different elastic cord and is configured to measure strain applied to the elastic cord to which it is coupled. A plurality of exercise devices is each affixed to the second end of one of the cords. An electronic exercise measurement device is mounted on the top plate and is electrically coupled to each of the electronic strain measuring devices. The electronic exercise measurement device is configured to generate an output signal indicative of exercises performed by each user based on the strain signal from each of the strain gauges. The electronic exercise measurement device includes: (i) a user identification circuit configured to identify each of a plurality of users each at a different one of the exercise locations, the user identification circuit including a plurality of different user identification sub-circuits, each disposed at a different location on the electronic exercise measurement device corresponding to a different exercise location relative to the integrated athlete training system, thereby facilitating the identification of each of the plurality of users; a plurality of electronic strain gauges, each coupled to a different one of the elastic cords and configured to generate an indication of an amount of strain to which each cord has been subjected; a processor that is responsive to the user identification circuit and to the strain gauges and that is configured to generate a data packet that includes an identification of each user and a digital representation of the indication of the amount of strain applied to a cord associated with each user; and a transceiver that is coupled to the processor, that is configured to transmit the data packet to a remote computer.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
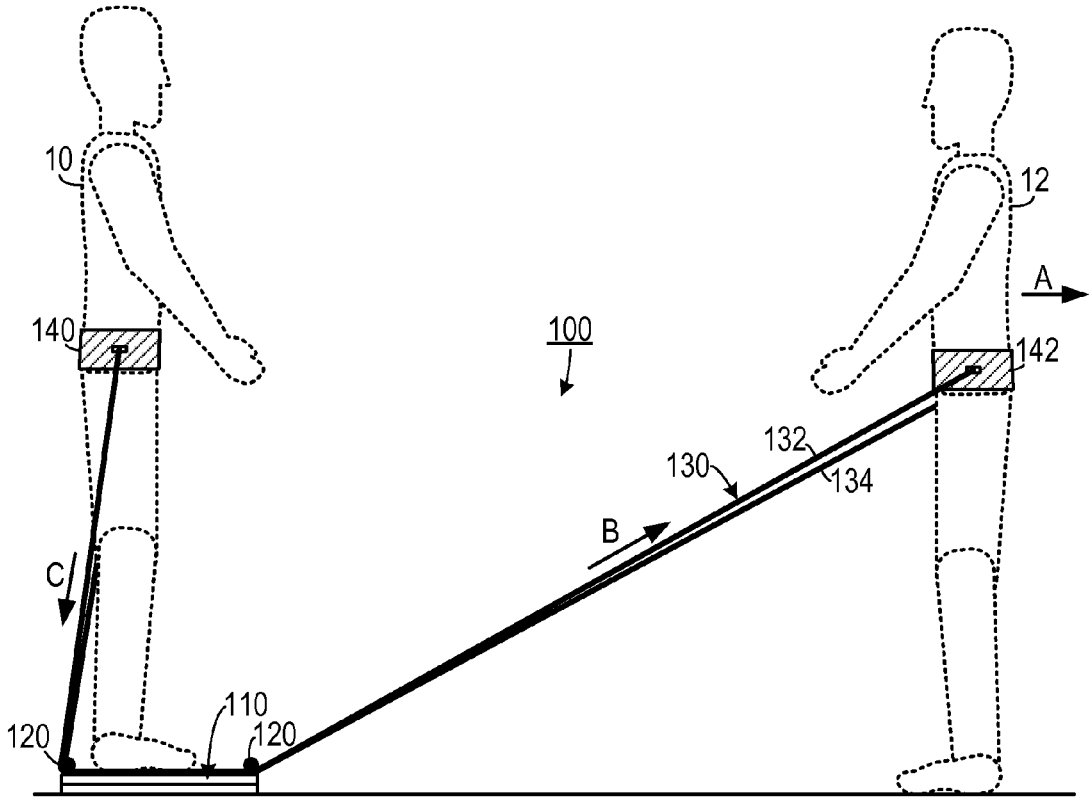
FIG. 1 is a schematic diagram showing a side view of one illustrative embodiment in use.

A preferred embodiment of the invention is now described in detail. Referring to the drawings, like numbers indicate like parts throughout the views. Unless otherwise specifically indicated in the disclosure that follows, the drawings are not necessarily drawn to scale. As used in the description herein and throughout the claims, the following terms take the meanings explicitly associated herein, unless the context clearly dictates otherwise: the meaning of "a," "an," and "the" includes plural reference, the meaning of "in" includes "in" and "on." Also, as used herein, "global computer network" includes the Internet.

Figure 2A:
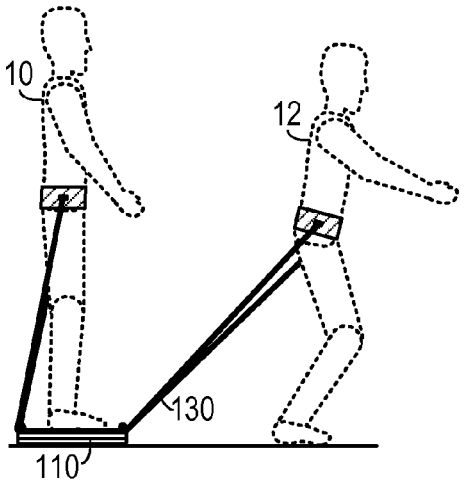
FIGS. 2A and 2B are schematic diagrams showing two athletes employing the embodiment show in FIG. 1 and alternating positions.
Figure 2B:
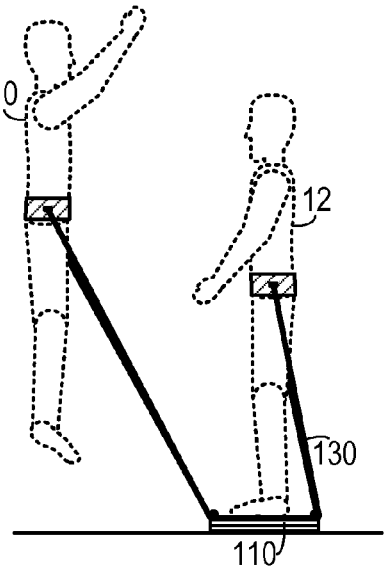
Figure 3:
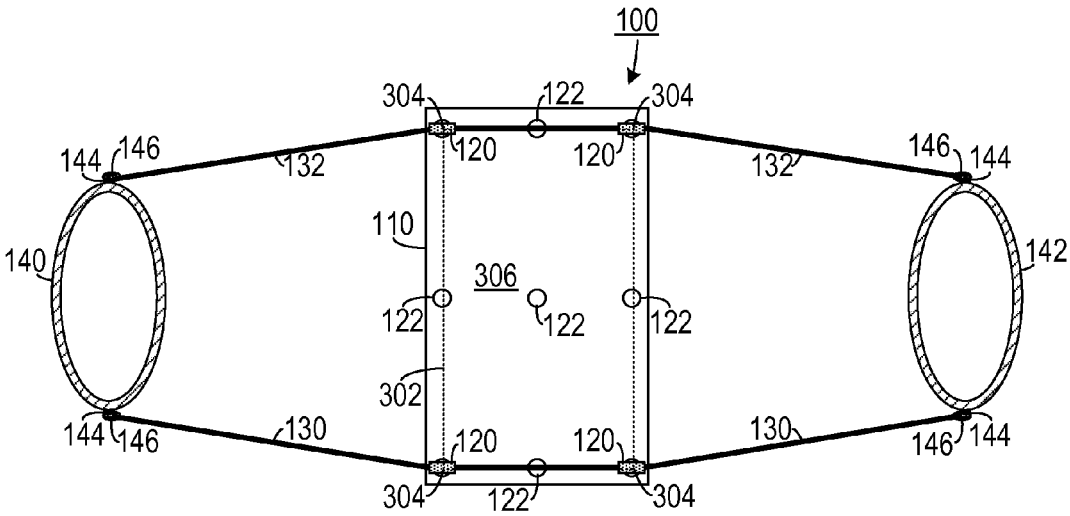
FIG. 3 is a top plan view of one embodiment.

As shown in FIGS. 1-3, one illustrative embodiment is an athlete training device 100 that includes a platform 110 upon which a first athlete 10 may stand. The platform 110 may be made of many materials, including plastic, wood, metal, or combinations thereof.

Four pulleys 120 that are mounted on the platform 110 engage an elastic member 130. The elastic member 130 can include, for example, a first bungee cord 132 and a second bungee cord 134. (Examples of other types of elastic members that may also be used include: rubber strips enshrouded with fabric; springs, elastic fabric and any other type of elongated elastic material.) The elastic member 130 is coupled at a first end to a first user coupler 140 and at the opposite second end to a second user coupler 142. The first user coupler 140 and the second user coupler 142 can each include a device such as a belt, a harness, or the like. The first user coupler 140 is coupled to the first athlete 10 and the second user coupler 142 is coupled to the second athlete 12.

As shown in FIG. 1, the first athlete 10 stands on the platform 110 while the second athlete 12 performs training exercises. When the second athlete 12 imparts a force on the elastic member 130 in, for example, direction A, a force in direction B is imparted on the platform, but is redirected to a force in direction C that is imparted on the first athlete 10. The presence of the first athlete 10 keeps the platform 110 stable and in position. The first athlete 10 is able to monitor the training of and provide support to the second athlete 12, thereby building a stronger team relationship between the athletes.

As shown in FIG. 1A, a training session might start with the first athlete 10 on the platform 110 while the second athlete 12 performs exercises. After completion of a set of exercises, the positions can switch, as shown in FIG. 2B, and the first athlete 10 will perform the training exercises while the second athlete stands on the platform 110. This position switching can occur repeatedly.

As shown in FIG. 3, the pulleys 120 may be disposed at the vertices 304 of an imaginary rectangle 302 that is projected onto the platform 110, inside of which is a standing area 306. The platform 110 may include a plurality of connection points 122 disposed thereon for connecting pulleys 120 thereto. Each connection point 122 includes a bolt to which a pulley 120 may be affixed. The user couplers 140 and 142 can include a couple of mounted D-rings 144 to which a device 146 can selectively couple the bungee cords 130 and 132. Such a device 146 could be, for example, a carabineer or a spring-loaded clip.

Figure 4:
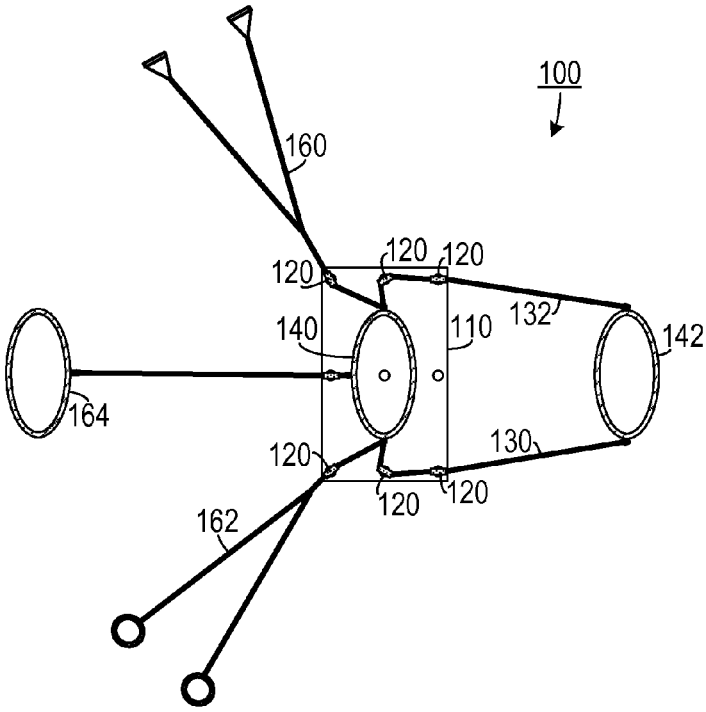
FIG. 4 is a top plan view of an embodiment configured to train more than two athletes simultaneously.

As shown in FIG. 4, more than two athletes can train on the device 100 simultaneously. For example, a first athlete (coupled to the first user coupler 140) could stand on the platform 110 while a second athlete trains as described above. A third athlete could use an elastic upper-body training device 160 that is coupled to the first user coupler 140 through a pulley. A fourth athlete could use an ankle-affixed elastic training device 162 that is coupled to the first user coupler 140 through a pulley. A fifth user could use a waist-affixed elastic training device 164 that is also coupled to the first user coupler 140 through a pulley. In this configuration, if all of the athletes were teamed up in pairs, eight athletes could be assigned to a single device 100 during a training session.

Figure 5:
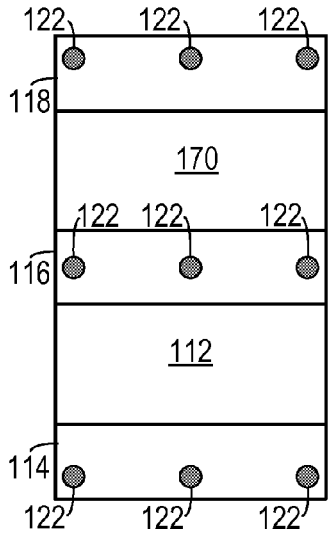
FIG. 5 is a bottom plan view of one embodiment.

As shown in FIG. 5, in one embodiment, the platform 110 includes a rectangular sheet 112 that is reinforced by three spaced support strips 114, 116 and 118 affixed to the bottom side 170 of the rectangular sheet 112 with bolts, which also serve as the connection points 122. Use of the support strips 114, 116 and 118 provides added rigidity to the device and also can set it more firmly in the ground.

Figure 6:
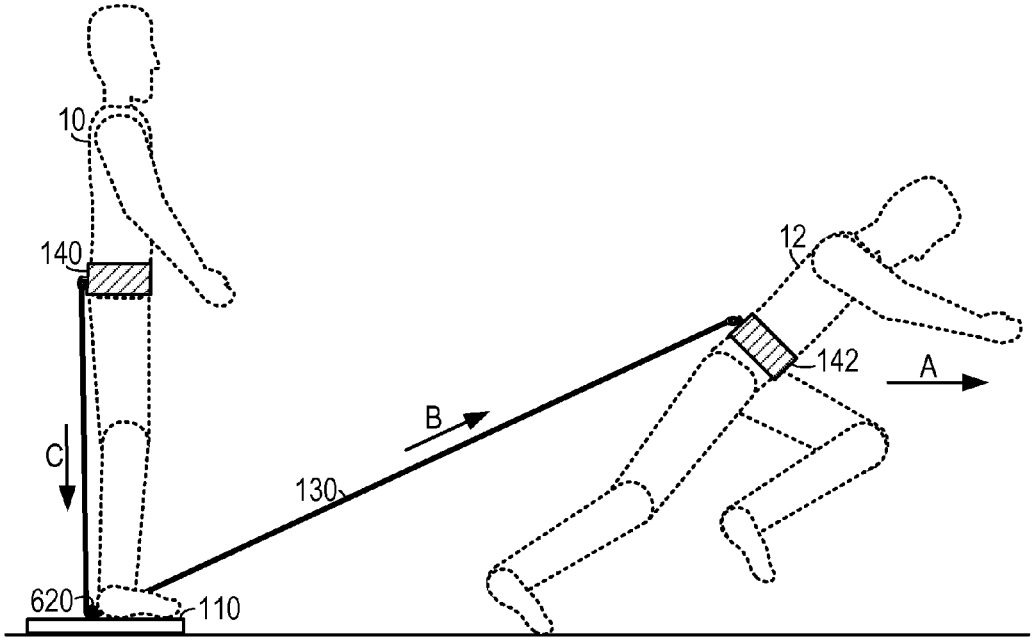
FIG. 6 is a schematic diagram showing an alternate embodiment.

In one simple embodiment, as shown in FIG. 6, a single force redirecting device 620 may be affixed to the platform. The single force redirecting device 620 could include a pulley, or it could be something as simple as an eye bolt or a D-ring. In this embodiment, only as single bungee cord us used as the elastic member 130.

Figure 7:
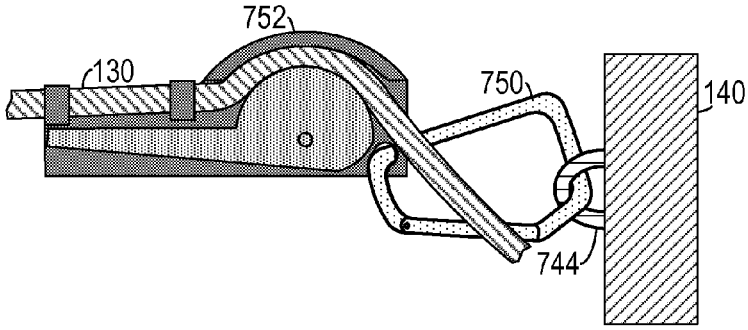
FIG. 7 is a schematic diagram showing one example of a mechanism that is configured to facilitate adjusting elastic member tension.
Figure 8A:
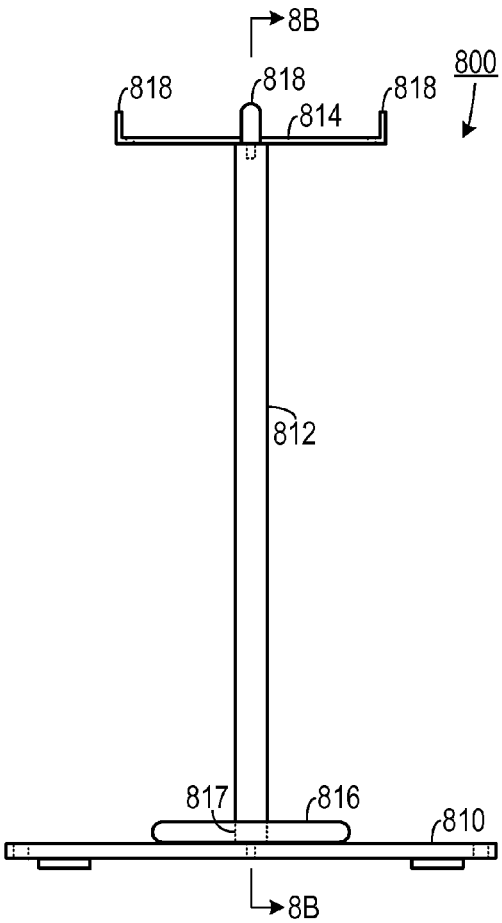
FIG. 8A is an elevational view of one embodiment of an athlete training device.
Figure 8B:
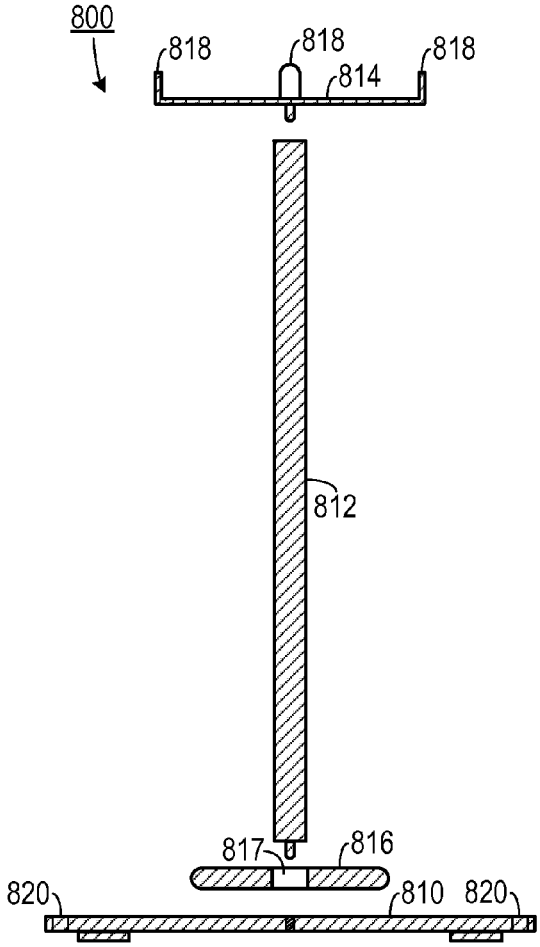
FIG. 8B is a cross-sectional view of the embodiment shown in FIG. 8A, taken along line 8B-8B.
Figure 9:
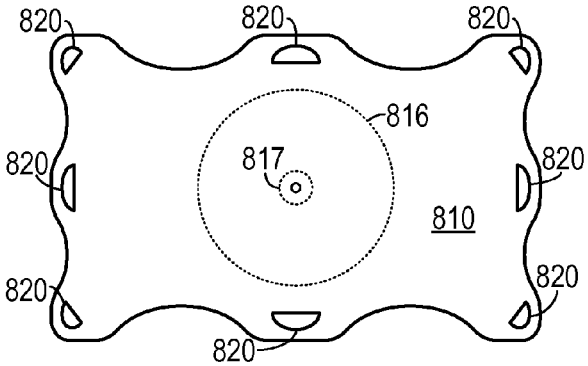
FIG. 9 is a plan view of a planar platform.
Figure 10:
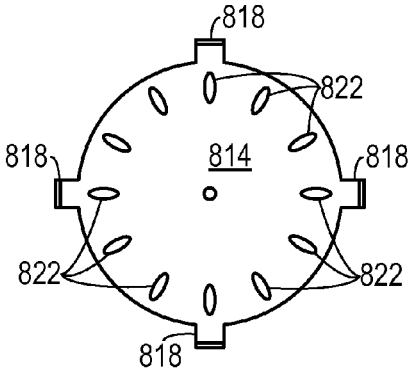
FIG. 10 is a plan view of a top plate.

The tension on the bungee cords can be adjusted simply by tightening them and then tying them in a knot around the D-ring attached to the user coupler belt. In another embodiment, as shown in FIG. 7, the elastic member 130 can be passed through a clamping mechanism 752, which is then used to hold the elastic member 130 in place once it is at the desired tension. The clamping mechanism 752 may be coupled to a D-ring 744 that is affixed to the user coupler 140 by using a carabineer 750 or a similar device. Many other tensioning devices may be employed.

As shown in FIGS. 8A-8B, 9 and 10, one embodiment of an athlete training device 800 employs a substantially planar platform 810 that defines a plurality of attachment members, such as passages 820 passing therethrough, adjacent the periphery of the platform 810. Other types of attachment members may be employed, including D-rings affixed to the platform, clips affixed to the platform and the like. An elongated pole 812 has a bottom end that is removably affixed to the platform 810 and a weight 816 that defines a hole 817 passing therethrough is placed on the platform 810 so that the pole 812 passes through the hole 817. The weight 816 applies sufficient downward force to the platform 810 so as to prevent lateral slippage of the platform 810 during use. The top plate 814 is affixed to the top end of the pole 812 and includes a plurality of spaced apart attachment structures disposed about the top plate 814. A plurality of tabs 818 can extend upwardly from the top plate 814 and are configured to hang cords and other devices therefrom. The platform 810 can be fitted with wheels (not shown) along one side to facilitate easy movement. In one representative embodiment, the platform 810, the pole 812, and the top plate 814 are made of steel.

Figure 11:
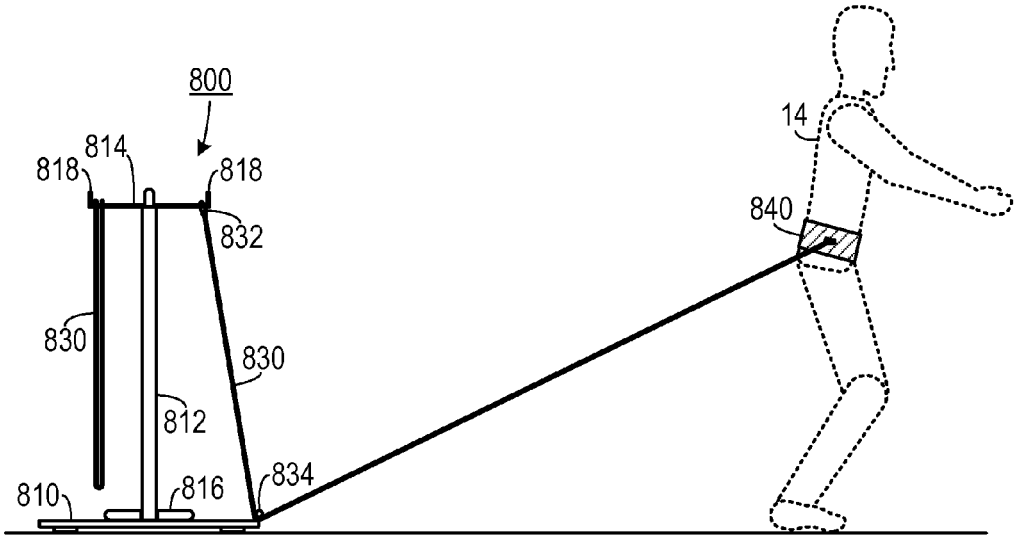
FIG. 11 is a schematic diagram of an athlete training device being used by one individual.
Figure 12:
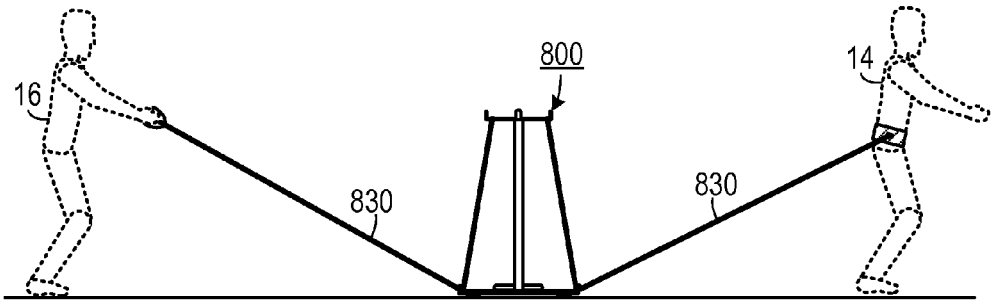
FIG. 12 is a schematic diagram of an athlete training device being used by two individuals.

As shown in FIG. 11, an attachment device 832, such as a carbineer, is engaged with one of the holes 822. A redirecting device 834 is coupled to passage 820 defined by the platform 810. Examples of redirecting devices include pulleys, D-rings and carabineers. An elastic bungee cord 830 has a first end that is attached to the attachment device 832 and is engaged with the redirecting device 834 so that the second end of the cord extends radially away from the pole 812. An exercise device 840 is affixed to the second end of the cord 830. Examples of exercise devices 840 include belts and harnesses explosiveness training, handles for upper body training, anklets for leg training, and the like. In this figure, a single athlete 14 is using the device and an extra cord 830 is stored by hanging it from one of the tabs 818. Two different athletes 14 and 16 are shown using the system in FIG. 12.

Figure 13:
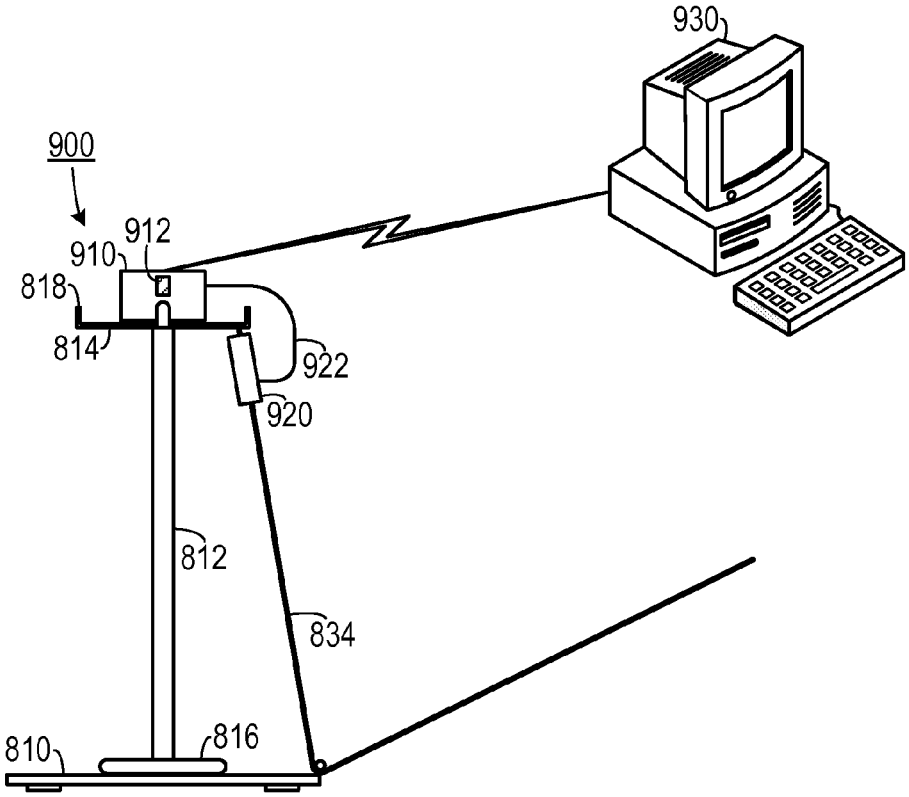
FIG. 13 is a schematic diagram of an embodiment employing an electronic exercise measurement system.

One embodiment, as shown in FIG. 13, includes an electronic exercise measurement device 900 associated with the training device. This embodiment employs an electronics console 910 that can be mounted on the top plate 814 that is in communication with at least one strain gauge 920, which is coupled to the elastic cord 834. The strain gauge 920 is in electronic communication with the electronics console 910 via a coaxial cable 922. The strain gauge senses an amount of strain that is applied to the elastic cord 834 and reports that amount to the electronics console 910. The electronics console 910 then reports the information to a remote computer 930. Thus, the system can track the performance of an athlete, including number of repetitions, force applied in each repetition, specific timing of each repetition and even the variation in force being applied during a single repetition (or group of repetitions) over time. In this way, a trainer can ensure compliance with a training regimen and can also observe specific trends in the training of the athlete. For example, if a profile of the force over time being applied during a repetition is different than what is expected, it might indicate that the athlete is in the early stages of suffering an overuse injury. Having the ability to determine that the athlete is about to suffer an injury would help the trainer change the regimen so as to prevent an injury.

In one embodiment, the electronics console 910 can also receive information from the remote computer 930 and display that information to the athlete. The electronics console 910 could, for example, include light-emitting diodes or a display that could be used to provide timing information to the athlete and instructions regarding the exercise regimen to be employed.

Figure 14:
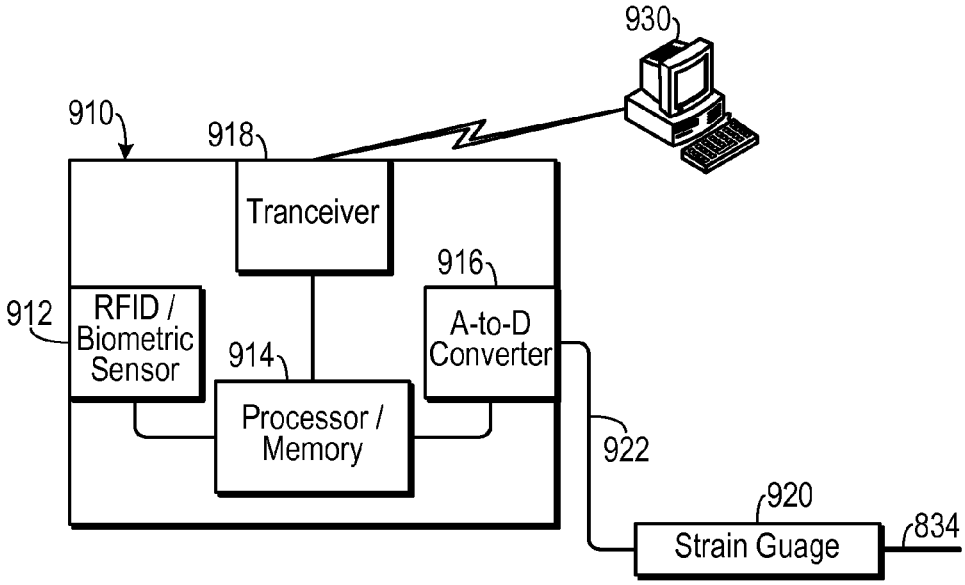
FIG. 14 is a schematic diagram of an electronic exercise measurement device and a strain gauge.

As shown in FIG. 14, the electronics console 910 can include a user identification circuit 912 used to identify an athlete. It could employ several user identification circuits 912 to identify different athletes exercising at different stations. Examples of suitable user identification circuits 912 include: biometric scanners, radio frequency identification (RFID) tag readers, keypads for entering a passcode, magnetic strip readers, single-wire communications device readers for reading a single-wire communications device (e.g., an iButton or a Dallas Key) and the like.

A processor 914, which can include a tangible computer readable memory (such as a flash memory, a hard drive, and the like) receives data from the user identification circuit 912 and from an analog-to-digital converter 916 in communication with the strain gauge 920. The processor is programmed to associate a specific strain gauge 920 with a specific athlete based on the data received from the user identification circuit 912. The processor also sends data regarding the athlete's performance to a transmitter (which could be part of a transceiver 918), which communicates with the remote computer 930.

The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. An athlete training device, comprising:

(a) a substantially planar platform having a periphery, the platform including a plurality of spaced apart attachment members disposed adjacent to the periphery of the platform;

(b) an elongated pole extending upwardly from the platform and having a bottom end and an opposite top end, the bottom end affixed to the platform;

(c) a weight defining a hole passing therethrough, the weight disposed on the platform so that the pole passes through the hole;

(d) a top plate affixed to the top end of the pole, the top plate including a plurality of spaced apart attachment structures disposed about the top plate;

(e) an attachment device coupled to a selected one of the attachment structures;

(f) a redirecting device coupled to a selected one of the attachment members;

(g) an elastic cord having a first end and an opposite second end, the first end attached to the attachment device, the elastic chord engaged with the redirecting device so that the second end of the cord extends radially away from the pole; and (h) an exercise device affixed to the second end of the cord.

2. The athlete training device of claim 1, wherein the attachment members comprise a plurality of passages defined by the platform so as to pass therethrough.

3. The athlete training device of claim 2, wherein the redirecting device comprises a pulley that is engaged with one of the passages.

4. The athlete training device of claim 1, wherein the attachment structures comprise a plurality of holes defined by the top plate so as to pass therethrough.

5. The athlete training device of claim 4, wherein the attachment device comprises a carbineer that is engaged with one of the holes.

6. The athlete training device of claim 1, further comprising an electronic exercise measurement device, comprising:

(a) a user identification circuit configured to identify a user;

(b) an electronic strain gauge coupled to the elastic cord and configured to generate an indication of an amount of strain to which the cord has been subjected;

(c) a processor that is responsive to the user identification circuit and to the strain gauge and that is configured to generate a data packet that includes an identification of the user and a digital representation of the indication of the amount of strain; and (d) a transceiver that is coupled to the processor, that is configured to transmit the data packet to a remote computer.

7. The athlete training device of claim 6, wherein the user identification circuit comprises a circuit selected from a group of circuits consisting of: a biometric sensor, an RFID tag reader, a magnetic strip reader, single-wire communications device, and combinations thereof.

8. The athlete training device of claim 6, wherein the user identification circuit comprises a plurality of different user identification sub-circuits, each disposed at a different location on the electronic exercise measurement device corresponding to a different exercise location relative to the athlete training device, thereby facilitating the identification of a plurality of users, each at a different one of the exercise locations.

9. The athlete training device of claim 1, further comprising a plurality of tabs extending upwardly from the top plate and configured to hang the cord therefrom.

10. An integrated athlete training system, comprising:

(a) a substantially planar platform having a periphery, the platform including a plurality of spaced apart attachment members disposed adjacent to the periphery of the platform;

(b) an elongated pole extending upwardly from the platform and having a bottom end and an opposite top end, the bottom end affixed to the platform;

(c) a weight defining a hole passing therethrough, the weight disposed on the platform so that the pole passes through the hole;

(d) a top plate affixed to the top end of the pole, the top plate including a plurality of spaced apart attachment structures disposed about the top plate;

(e) an attachment device coupled to a selected one of the attachment structures;

(f) a redirecting device coupled to a selected one of the attachment members;

(g) an elastic cord having a first end and an opposite second end, the first end attached to the attachment device, the elastic chord engaged with the redirecting device so that the second end of the cord extends radially away from the pole;

(h) an exercise device affixed to the second end of the cord;

(i) an electronic strain measuring device coupled to the cord and configured to generate a strain signal representative of strain applied to the cord; and (j) an electronic exercise measurement device that is responsive to the strain signal and that is configured to generate an output signal indicative of exercises performed by a user based on the strain signal.

11. The integrated athlete training system of claim 10, wherein the attachment members comprise a plurality of passages defined by the platform so as to pass therethrough.

12. The integrated athlete training system of claim 11, wherein the redirecting device comprises a pulley that is engaged with one of the passages.

13. The integrated athlete training system of claim 10, wherein the attachment structures comprise a plurality of holes defined by the top plate so as to pass therethrough.

14. The integrated athlete training system of claim 13, wherein the attachment device comprises a carbineer that is engaged with one of the holes.

15. The integrated athlete training system of claim 10, wherein the electronic exercise measurement device comprises:

(a) a user identification circuit configured to identify a user;

(b) an electronic strain gauge coupled to the elastic cord and configured to generate an indication of an amount of strain to which the cord has been subjected;

(c) a processor that is responsive to the user identification circuit and to the strain gauge and that is configured to generate a data packet that includes an identification of the user and a digital representation of the indication of the amount of strain; and (d) a transceiver that is coupled to the processor, that is configured to transmit the data packet to a remote computer.

16. The integrated athlete training system of claim 15, wherein the user identification circuit comprises a circuit selected from a group of circuits consisting of: a biometric sensor, an RFID tag reader, a magnetic strip reader, single-wire communications device, and combinations thereof.

17. The integrated athlete training system of claim 15, wherein the user identification circuit comprises a plurality of different user identification sub-circuits, each disposed at a different location on the electronic exercise measurement device corresponding to a different exercise location relative to the integrated athlete training system, thereby facilitating the identification of a plurality of users, each at a different one of the exercise locations.

18. The integrated athlete training system of claim 10, wherein the electronic exercise measurement device is mounted on the top plate and is coupled to the stain gauge with a coaxial cable.

19. The integrated athlete training system of claim 10, further comprising a plurality of tabs extending upwardly from the top plate and configured to hang the cord therefrom.

20. An integrated athlete training unit, comprising:

(a) a substantially planar platform having a periphery, the platform including a plurality of passages defined by the platform so as to pass therethrough;

(b) an elongated pole extending upwardly from the platform and having a bottom end and an opposite top end, the bottom end affixed to the platform;

(c) a weight defining a hole passing therethrough, the weight disposed on the platform so that the pole passes through the hole;

(d) a top plate affixed to the top end of the pole, the top plate defining a plurality of holes passing therethrough disposed about the top plate;

(e) a plurality of carabineers, each of which is coupled to a different one of the holes;

(f) a plurality of pulleys, each of which is coupled to a different one of the attachment members;

(g) a plurality of elastic cords, each of which has a first end and an opposite second end, the first end attached to one of the carabineers, each elastic chord engaged with one of the pulleys so that the second end of the cord extends radially away from the pole;

(h) a plurality of strain measuring devices, each of which is coupled to a different elastic cord and configured to measure strain applied to the elastic cord to which it is coupled;

(i) a plurality of exercise devices, each of which is affixed to the second end of one of the cords; and (j) an electronic exercise measurement device, mounted on the top plate and electrically coupled to each of the electronic strain measuring devices, the electronic exercise measurement device configured to generate an output signal indicative of exercises performed by each user based on the strain signal from each of the strain gauges, the electronic exercise measurement device including:

(i) a user identification circuit configured to identify each of a plurality of users each at a different one of the exercise locations, the user identification circuit including a plurality of different user identification sub-circuits, each disposed at a different location on the electronic exercise measurement device corresponding to a different exercise location relative to the integrated athlete training system, thereby facilitating the identification of each of the plurality of users;

(ii) a plurality of electronic strain gauges, each coupled to a different one of the elastic cords and configured to generate an indication of an amount of strain to which each cord has been subjected;

(iii) a processor that is responsive to the user identification circuit and to the strain gauges and that is configured to generate a data packet that includes an identification of each user and a digital representation of the indication of the amount of strain applied to a cord associated with each user; and (iv) a transceiver that is coupled to the processor, that is configured to transmit the data packet to a remote computer.

* * * * *